United States Patent [19]

Conne

[11] 4,106,074

[45] Aug. 8, 1978

[54] TRIGGERING HEAD FOR DEVICES CONTROLLED BY AN ELECTRIC POWER INPUT

[75] Inventor: Robert H. Conne, Geneva, Switzerland

[73] Assignee: Brevetor S.A., Vaduz, Switzerland

[21] Appl. No.: 669,472

[22] Filed: Mar. 23, 1976

[30] Foreign Application Priority Data

Oct. 23, 1975 [CH] Switzerland ..... 13729/75

[51] Int. Cl.[2] ..... F42B 3/10

[52] U.S. Cl. ..... 361/248; 361/249; 102/215

[58] Field of Search ..... 317/80; 102/70.2 R, 102/19.2, 82, 8; 340/256, 276; 361/248, 249

[56] References Cited

U.S. PATENT DOCUMENTS

| | | | |
|---|---|---|---|
| 3,424,924 | 1/1969 | Leisinger et al. | 102/70.2 R |
| 3,665,860 | 5/1972 | West | 102/19.2 |
| 3,690,259 | 9/1972 | Piazza et al. | 102/70.2 R |
| 3,712,218 | 1/1973 | Fay | 102/70.2 R |
| 3,934,514 | 1/1976 | Dawkins | 317/80 |
| 3,972,039 | 7/1976 | Marshall | 340/256 |

*Primary Examiner*—J. V. Truhe
*Assistant Examiner*—Clifford C. Shaw
*Attorney, Agent, or Firm*—Cushman, Darby & Cushman

[57] ABSTRACT

The triggering head comprises a case containing a battery connected by means of an electronic switching device to the terminals of an output intended for connection of the device to be triggered and a control circuit fed by the battery and comprising several double-pole inputs mounted in series and a starting switch with external actuation. The control circuit functions to make the electronic switching device conductive when, the starting switch having been actuated, the potential difference appearing across the end poles of the inputs exceeds a predetermined value.

12 Claims, 6 Drawing Figures

Fig. 3a
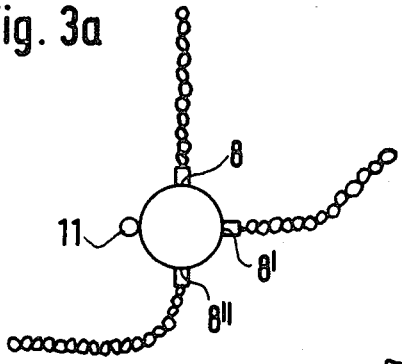
Fig. 3b
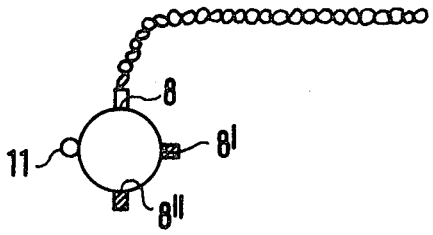
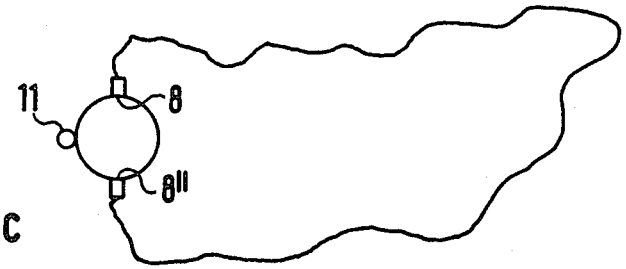
Fig. 3c
Fig. 4
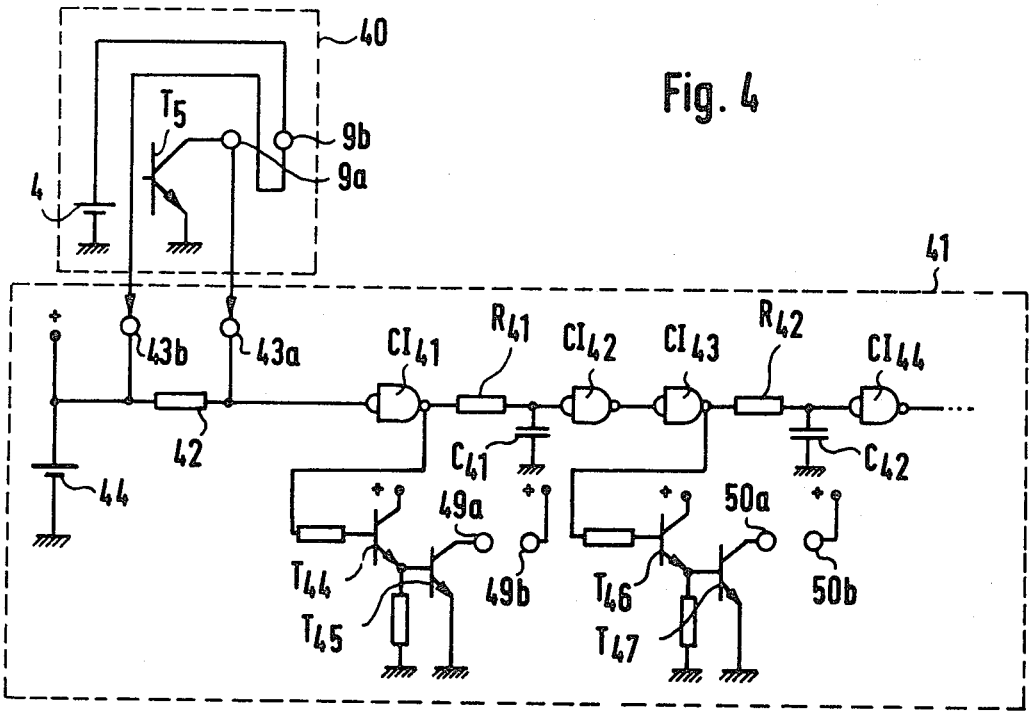

TRIGGERING HEAD FOR DEVICES CONTROLLED BY AN ELECTRIC POWER INPUT

BACKGROUND OF THE INVENTION

The present invention relates to a triggering head for devices of the type operated by an electric power input and to the use of such a triggering head.

Devices operated by an electric power input include, for example, lighting, incendiary or explosive devices in which the electric power, supplied by the triggering head, causes the firing of a charge. Other types of devices which can be triggered include electrically operated alarm or monitoring devices.

OBJECTS AND SUMMARY OF THE INVENTION

The object of this invention is to provide a triggering head of very small outside dimensions, allowing numerous different uses in the field of detection and intervention, and offering, particularly in the case of its use for firing destructive devices, maximum safety for an operator.

For this purpose, the triggering head according to the invention comprises a case containing at least a battery which is connected by means of an electronic switching device to the terminals of an outlet intended for connection of the device to be triggered. The triggering head also comprises a control circuit fed by the battery or batteries and includes one or more double-pole inputs, mounted in series, together with an externally actuated starting switch. The control circuit causes the electronic switching device to become conductive when, the starting switch having been actuated, the potential difference appearing across the inputs exceeds a predetermined value.

The present triggering head can be used for surveillance of a predetermined zone, and particularly for detecting the presence of a moving object, animal or person in this zone.

In using the triggering head of this invention an outside detection circuit is connected to the head inputs. The outside detection circuit can be of any type where detection of a phenomenon is reflected by the exceeding of a predetermined value of the potential difference across the end poles of the input. Further advantages and possibilities of use of the present triggering head will be brought out by the following description considered with the accompanying drawings which illustrate, by way of example, an embodiment of the invention and the different uses to which it can be put.

BRIEF DESCRIPTION OF THE DRAWINGS

FIGS. 3*a*, 3*b* and 3*c* are diagrams of different examples of connection of detection loops.

FIG. 4 is a partial diagram of a circuit of a multiple control installation using the triggering head according to FIG. 1.

DETAILED DESCRIPTION

Figure 1:
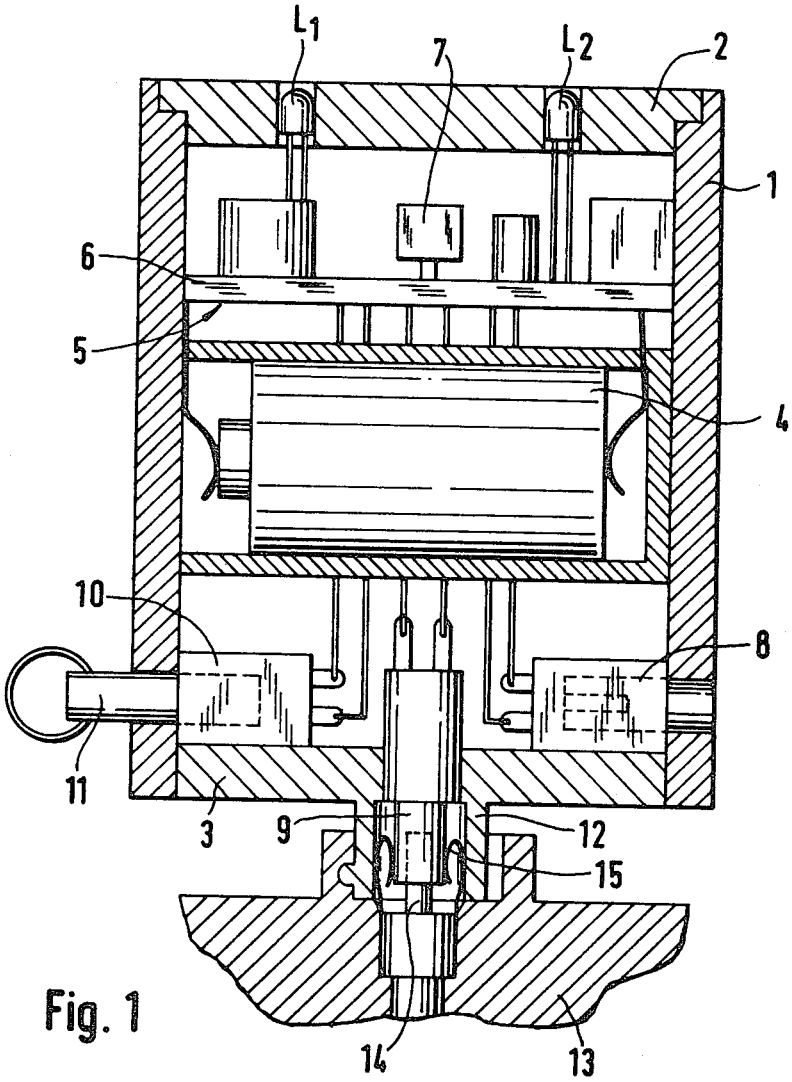
FIG. 1 is a schematic representation, in axial cross section, of an embodiment of a triggering head according to the invention.

The schematic representation of FIG. 1 gives an example of the physical arrangement of the main elements of one embodiment of a triggering head in accordance with the invention. A case is provided which comprises a tubular piece 1, a cover 2 and an end piece 3. A battery or batteries 4 connected together, are suitably supported within the case and constitute an electric power source for supplying power to an electric control circuit 5 and to outside elements connected to this circuit. Control circuit 5 comprises, in accordance with this embodiment, a printed circuit plate 6 and components such as 7 mounted on this plate.

Further, printed circuit 6 is connected to two signal lights $L_1$ and $L_2$, red and green respectively, mounted in cover 2, and to input 8 and output 9 as well as to a mechanical switching device 10 placed in the lower part of the case. Switching device 10 comprises a starting pin 11 which can be pulled from its housing to actuate the switch.

Output 9 is a double-pole female outlet housed in the center of bottom piece 3 of the case. The bottom piece 3 of the case presents a base 12 surrounding output 9 which allows the attachment of the case to body 13 of a device to be triggered. Electrical connection with this device is made, in the case shown, by a central plug 14 engaging in output 9 and by peripheral contact springs 15. When plug 14 has not been introduced into outlet 9, these springs 15 establish a short-circuit by resting on plug 14, which is an important advantage in the case where, for example, the device to be triggered is an explosive device with electric ignition.

The inputs, of which only input 8 can be seen in FIG. 1, are also double-pole female sockets. In accordance with one embodiment, three identical sockets are, for example, distributed at angular distances of 90° on the lower perimeter of the case.

Figure 2:
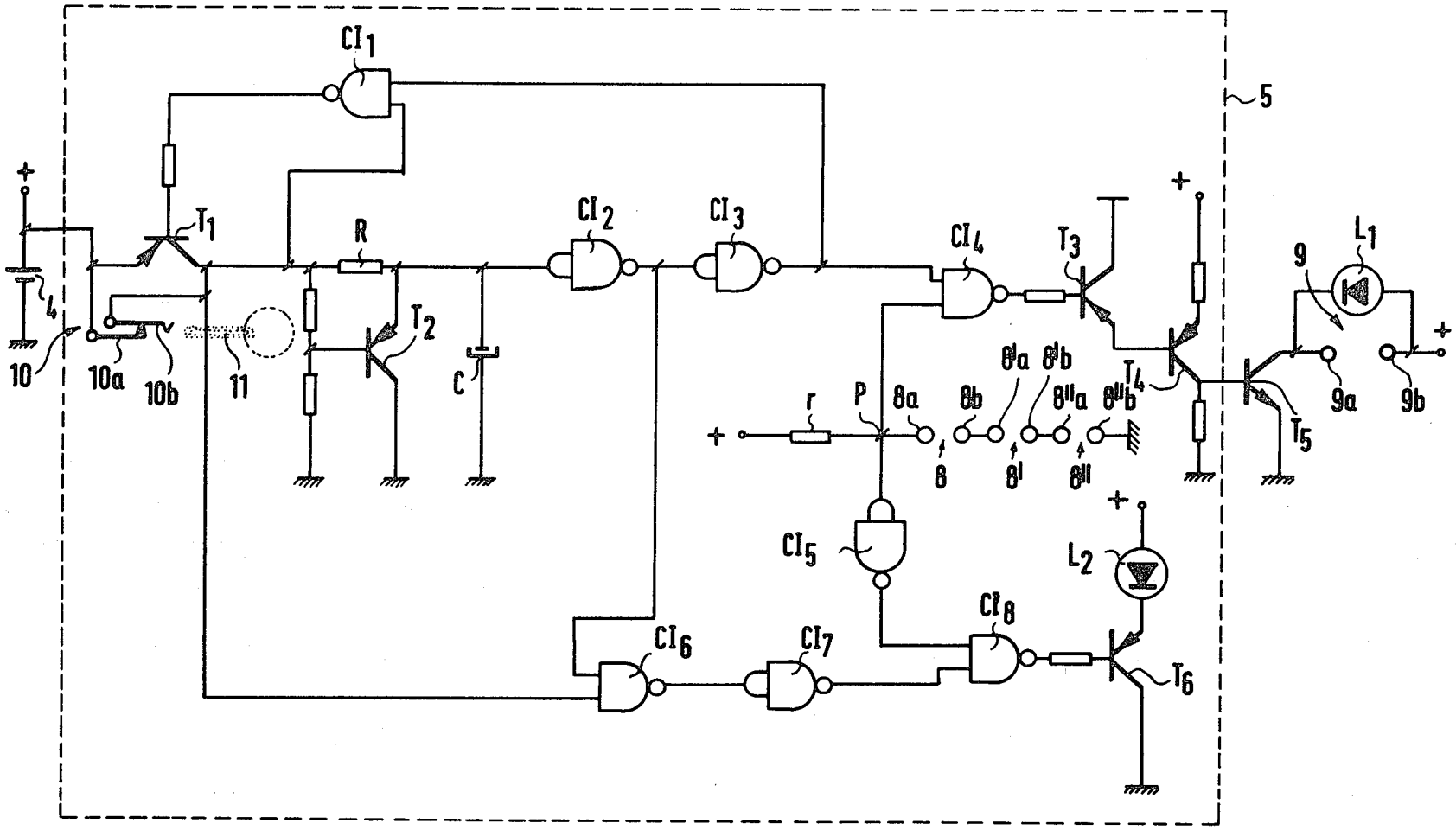
FIG. 2 is a diagram of the electric circuit of the triggering head according to FIG. 1.

FIG. 2 shows the electric diagram of the triggering head of FIG. 1. The elements already mentioned are designated in FIG. 2 by the same reference numbers. The two poles of output 9 are represented in the diagram by terminals 9*a* and 9*b*. Terminal 9*b* is connected directly to the positive pole of battery 4, terminal 9*a* is connected, by means of the collector-emitter path of a transistor $T_5$ to the ground of the circuit which corresponds to the negative pole of battery 4.

Transistor $T_5$ constitutes an electronic switching device which is operated by control circuit 5. Thus, when $T_5$ is made conductive, terminals 9*a* and 9*b* supply electric power from battery 4 to the device to be triggered, which is connected to the output socket.

Control circuit 5 comprises logic circuits $CI_1$ to $CI_8$ of the AND-NOT (NAND) type having two inputs and one output. These logic circuits are preferably identical so as to simplify manufacturing and repair, and are only partly used as logic circuits proper.

In a preferred embodiment, the logic circuits are complementary MOS (CMOS) transistor integrated circuits, this technique making it possible to have very high input impedances. In this case, the power consumption of the control circuit can be made very slight, which is particularly important in applications where the triggering head should be able to remain in the standby watch state as long as possible. The high value of the input impedance of the circuits used also makes it possible to obtain very great sensitivity of the control circuit, and thus offers very broad application possibilities, such as those that are mentioned below.

As the diagram shows, the two mechanical contacts 10*a* and 10*b* of the mechanical switch device are connected respectively to the positive pole of the battery 4 and, by means of a resistance R, to the inputs of the circuit $CI_2$. A capacitor C is connected between these same inputs and the ground. The output of circuit $CI_2$ is connected to the two inputs of a circuit $CI_3$ whose output is connected to one of the inputs of a logic circuit $CI_4$. The other input of $CI_4$ is connected to a point P which is the point of connection of one of the end poles of the inputs and of a resistance *r*, connected on the other hand, to the positive pole of battery 4.

The control circuit comprises, for example, three inputs 8, 8' and 8'' whose poles are represented respectively by terminals 8*a* and 8*b*, 8'*a* and 8'*b*, 8''*a* and 8''*b*. These inputs are mounted in series between point P and the ground, i.e., 8*a* is connected to P, 8*b* to 8'*a*, 8'*b* to 8''*a* and 8''*b* to the ground.

When contacts 10*a* and 10*b* of the starting switch are closed by withdrawal of pin 11, the positive potential of battery 4 is applied to the inputs of $CI_2$ with a time lag determined by elements R and C forming a delay circuit. With the same delay, the positive potential appears at the output of $CI_3$, i.e., at the input of logic circuit $CI_4$.

The potential of point P is negative when the end terminals 8*a* and 8''*b* of the inputs are connected together by an outside connection estabishing a conductive path between these terminals. For example, conductive detection wires can be connected respectively between the pairs of poles of each of the inputs. In a state of standby watch, the potentials appearing at the inputs of the logic circuit $CI_4$ are of different polarity and the output of $CI_4$ blocks a pnp transistor $T_3$ whose base is connected by means of a resistance to the output of $CI_4$. The collector of this transistor $T_3$ is connected to the ground and its emitter to the base of a transistor $T_4$ of the same type. The emitter of $T_4$ is connected to the positive pole of battery 4 by means of a slight value resistance and its collector is connected to the base of transistor $T_5$ and, by means of a resistance of relatively large value, to the ground. When transistor $T_4$ is blocked as a result of $T_3$, transistor $T_5$ which, in the example described, is of the npn type, is also blocked.

If one of the above-mentioned outside connections of inputs 8, 8', 8'' is broken, point P is no longer connected to the ground and passes to the positive potential of the battery. In other words, a potential difference equal to the voltage of the battery appears between outside terminals 8*a* and 8''*b*. The two inputs of logic circuit $CI_4$ then being at positive potentials, a negative potential appears at the output of this circuit. Transistors $T_3$ and $T_4$ therefore become conductive and transistor $T_5$, whose base is thus also at a positive potential, is in a state of conduction and supplies a current to a charge or device connected between terminals 9*a* and 9*b*. Signal light $L_1$ of the semiconductor type, connected in parallel to these terminals, indicates the state of conduction of $T_5$ and thus finishes, in certain applications, a danger signal.

Circuit 5 further comprises green signal light $L_2$ which is controlled in the following way. The positive potential of battery 4 is applied, after closing of contacts 10*a* and 10*b* of the starting switch, to an input of a logic circuit $CI_6$. The other input of circuit $CI_6$ is connected to the output of circuit $CI_2$. The output of $CI_6$ is therefore at a negative potential during the entire period of charging of capacitor C and only during that time. Actually, once the capacitor has been charged, the output of $CI_2$ becomes negative and again causes the negative potential of the output of $CI_6$ to disappear. During the delay interval, the negative potential of $CI_6$ is applied by means of a circuit $CI_7$ whose inputs are connected together, to a first input of logic circuit $CI_8$. The second input of $CI_8$ is connected to the output of a circuit $CI_5$ whose two inputs are connected to point P. The output of $CI_8$ is connected by means of a resistance to the base of a pnp transistor $T_6$ whose collector-emitter circuit comprises the light $L_2$. If point P is connected to the ground by means of the unbroken outside connections between the end terminals 8*a* and 8''*b* of the inputs, the potential at the second input of $CI_8$ is positive and this logic circuit supplies a negative potential to the base of transistor $T_6$. The latter therefore is, in this case, conductive during the period of charging of the capacitor C and light $L_2$ is lit during this delay phase.

On the other hand, if the connection between the end terminals of the inputs is interrupted or, for example, the battery is defective, the light does not light and consequently indicates a defect.

In the example illustrated by FIG. 2, the control circuit comprises, besides the mechanical switching device formed by elements 10 and 11, a transistor $T_1$ whose emitter-collector path is mounted in parallel to contacts 10*a* and 10*b* and whose base is connected, by means of a resistance, to the output of a logic circuit $CI_1$. The two inputs of this logic circuit are operated respectively by the potential at the input of delay circuit RC and by that which appears at the output of $CI_3$. These two potentials both being positive from the end of the delay interval, the base of transistor $T_1$ is at a negative potential and $T_1$ is conductive. From this moment, a new introduction of pin 11 in its housing therefore no longer makes it possible to unprime the triggering head. On the other hand, during the delay phase, it is possible, by opening contacts 10*a* and 10*b* by introduction of pin 11, to interrupt the process of charging the capacitor and to bring the triggering head back to its original state. For this purpose, the emitter-collector path of a pnp transistor $T_2$ is mounted in parallel with capacitor C and the base of $T_2$ is connected to an intermediate point of a voltage divider connected between contact 10*b* and the ground. In this way, if pin 11 is again introduced into its housing, transistor $T_2$ which was blocked by the appearance of a positive potential at its base during the closing of contacts 10*a* and 10*b*, is made conductive by connection of its base to the ground and thus capacitor C discharges.

The examples of different uses of the present triggering head given above show the advantages procured by the different parts of the circuit. However, it should be noted that for certain uses the delay circuit RC and/or the corresponding discharge circuit, and also the circuit making priming irreversible after the passage of the delay interval, or the green light control circuit can, for example, be eliminated, which makes it possible to consequently simplify the circuit unit.

The present triggering head can be used in particular for firing explosive devices in an installation for surveillance of a given area. For this purpose, the triggering head is fastened, for example, on an explosive device so as to connect the output to the connections of a firing charge. Detection of a movement inside the area to be kept under surveillance occurs by means of conductive wires of very small diameter placed in this area so as to constitute a trap. These wires can form one or more loops whose breaking leads to the actuating of the head in the way described above and consequently, to firing of the corresponding device.

FIGS. 3*a*, 3*b* and 3*c* schematically show different ways of connecting the loops of detection wire to the present triggering head.

In the case of FIG. 3*a*, three loops are made up of a bifilar wire and are connected respectively by double-pole plugs to inputs 8, 8' and 8'' to establish a conductive path between the end terminals 8*a* and 8''*b* of FIG. 2. The length and diameter of the wire used for the unit of these loops are limited by the maximal resistance that can be introduced between point P and the ground to assure the functioning of the circuit. In case circuits $CI_4$ and $CI_5$ are made with CMOS technology, the high input impedance of these circuits offers the possibility of giving a great value to the resistance of the outside conductive path and thus permits the use of particularly long loops of very fine wire. The loops can be placed in any direction and are practically invisible on the ground.

In the case of FIG. 3*b*, a single loop of bifilar wire is used and inputs 8' and 8'' are provided with short-circuiting plugs to form an uninterrupted conductive path between terminals 8*a* and 8''*b*. The length of the single loop can obviously be approximately equal to the total length of the three loops of FIG. 3*a*.

FIG. 3*c* shows the case of a single open loop made of a single wire. The connection of this wire takes place by means of plugs introduced into sockets 8 and 8'' and arranged so that the wire connects terminals 8*a* and 8''*b*, socket 8' not having any effect on the circuit.

When a surveillance installation as described above is put in place, the following procedure is used.

First, a check is made to see that red signal light $L_1$ is not lit. If this light is lit, the head is to be rejected, because it is set and generally in an irreversible way.

If the red light is out, the triggering head is placed on the device, the plugs are introduced into the inputs and the detection wire is put in place on the ground as a trap. Then the starting pin is pulled out and the green light checked. If it is lit, the installation is in order and definitely becomes operational at the end of the delay period. The operator has this period, which for example is a hundred seconds, to get away safely.

If the green light is not lit, the loop installation has a defect, for example, a break in the wire or a bad contact at the site of the plugs. In this case, the starting pin should immediately be replaced and the wire installation checked before removing the pin again.

A form of installation similar to that which uses detection loops according to FIG. 3*c* for example consists in connecting each of the inputs used to two spaced spots of an existing wire, such as a barbed wire, for example. This makes it possible to monitor the intact state of such a wire and to trigger a delayed reaction at a predetermined place by placing of a device.

In the above examples, the outside detection circuit connected between the end poles 8*a*, 8''*b* of the inputs was made up of conductors through which a monitoring current passed and an interruption of this circuit produced a variation in the potential difference appearing between these poles. In other applications, a variable impedance can be connected between the poles 8*a* and 8''*b*, the value of this impedance being a function of a magnitude or external state to be monitored. This is the case particularly in certain infrared detectors. It is also possible to use an active element or apply, by means of the detection circuit, a suitable signal voltage between these poles to influence the control circuit.

Another form of use of the present triggering head is, for example, that of an independent delay igniter. In this case, the inputs stay open. The case is placed on an explosive or incendiary device, the starting pin is removed, and the device is thrown or left at the desired spot by using the ignition delay to get away or take cover.

Similarly, it is also possible to use the starting pin to control a device at a distance by means of a taut cable or the like. This latter is attached by one end to pin 11 and by the other end to a stationary fastening point or to an object that is to actuate the device by its movement in relation to the triggering head. The pin is thus removed by the pull exerted on the cable and, the inputs being open, the triggering is produced under the effect of this internal mechanical action.

FIG. 4 represents schematically a form of use of the present triggering head in which several devices to be triggered can be operated from the same head by means of a connecting device.

A triggering head 40 is symbolized in this figure by the contour in broken lines in which are represented the output circuit with terminals 9*a*, 9*b* of the socket, transistor $T_5$ and battery 4, the circuit unit not represented being, for example, identical with that of FIG. 2. The triggering head is connected electrically and fastened mechanically to a connecting device 41, terminals 9*a* and 9*b* being connected respectively to input terminals 43*a*, 43*b* of this device. A resistance 42 of relatively high value is connected between terminals 43*a* and 43*b*, this latter being connected to the positive pole of a secondary battery 44 whose negative pole is connected to the ground of device 41.

The connecting device comprises a certain number of circuits $CI_{41}$, $CI_{42}$, $CI_{43}$, $CI_{44}$ . . . of the same type as circuits $CI_1$ to $CI_8$ of FIG. 2. Terminal 43*a* is thus connected to the two inputs of a circuit $CI_{41}$. The output of $CI_{41}$ is connected by means of a resistance to the base of a transistor $T_{44}$ whose collector is connected to the positive pole of battery 44 and whose emitter is connected to the base of a second transistor $T_{45}$, and by means of a resistance, to the ground of 41. The emitter of $T_{45}$ is also connected to this ground and the collector of this transistor is connected to an output terminal 49*a*. A second output terminal 49*b* is connected to the positive potential of battery 44.

Moreover, the output of $CI_{41}$ is connected by means of a resistance $R_{41}$ to the two inputs of a circuit $CI_{42}$. A capacitor $C_{41}$ is connected between these two inputs and the ground of 41. The output of $CI_{42}$ is connected to the two inputs of a circuit $CI_{43}$ and the output of this latter is connected, by means of a resistance, to the base of a transistor $T_{46}$. This transistor $T_{46}$ and a transistor $T_{47}$ are connected in the same way as the pair of transistors $T_{44}$ and $T_{45}$. The collector of $T_{47}$ is connected to an output terminal 50*a*, the corresponding terminal 50*b* being connected to the positive pole of battery 44. The unit of the circuit connected between the output of $CI_{41}$ and the output of $CI_{43}$ forms a secondary delay control circuit. Connecting device 41 contains a certain number of such secondary control circuits connected in series as shown in FIG. 4, in which only the elements $R_{42}$, $C_{42}$ and $CI_{44}$ of the following circuit have been represented.

The various devices to be triggered represent charges connected respectively between terminals 49*a*, 49*b*; 50*a*, 50*b*; etc.

Triggering is performed in the following way. When transistor $T_5$ of head 40 becomes conductive as a result of a break in the external conductive path associated with this head, such as that described in relation to FIG. 2, terminal 43*a* which, in the watch state, was at the positive potential of battery 44 and battery 4, passes to a negative potential, which is that of ground 40. Circuit $CI_{41}$ thus supplies at its output a positive potential which makes transistor $T_{44}$ conductive. Transistor $T_{45}$ is also put in the conductive state and allows the passage of a current through a charge connected between 49*a* and 49*b*. The positive potential at the output of $CI_{41}$ is applied by means of the delay circuit made up of $R_{41}$ and $C_{41}$, to the inputs of $CI_{42}$ and causes a positive potential to appear at the output of $CI_{43}$. The presence of this potential makes transistors $T_{46}$ and $T_{47}$ conductive and triggers the device connected to terminals 50*a*, 50*b*.

In a similar way, each of the following devices is triggered with a certain delay, determined by the corresponding circuits RC, in relation to the previous device.

Such an installation therefore makes it possible to produce, from a single triggering head and the detection loops associated with it, a reaction produced in space, by the distribution of the various devices to be triggered that are connected to the connecting device and extended in time by the successive delays in the triggering of these devices.

In a variant embodiment of the connecting circuit 41, the latter can comprise a memory circuit which makes it possible to make the triggering independent of the presence of head 40 once the triggering signal has been supplied to 43*a*, 43*b*. Such a variant consists, for example, in connecting only one input of circuit $CI_{41}$ to 43*a* and in connecting the other input to the output of a supplementary logic circuit of the same type whose two inputs are connected together at the output of $CI_{41}$. This supplementary logical circuit assures the continuity of the application of a negative potential to the corresponding input of circuit $CI_{41}$ as soon as this latter has triggered once under the action of the triggering signal.

Thus, it can be seen that the present triggering head has a certain number of features of great practical importance, namely: its design in the form of a separate triggering device not containing a charge, the presence of several inputs having great sensitivity, the presence of an externally actuating starting switch, the presence of a delay circuit, the presence of control lights, and the possibility of making the circuit non-unprimable after the delay phase.

While a particular embodiment of the invention has been shown and described, it should be appreciated that various modifications may be made by those skilled in the art without departing from the true spirit and scope of the invention.

I claim:

1. A triggering head for devices of the type operated by an electric power input comprising a case separate from the device to be operated containing at least one electric battery, a control circuit fed by the or each battery, and an electronic switching device connected to the control circuit for delivering the electric energy of the or each battery to a device to be triggered, the control circuit comprising an externally actuated starting switch and at least one double-pole input, the potential difference appearing across the end poles of which determines the state of the electronic switching device through the control circuit when the starting switch has been actuated, and wherein the case comprises an output plug for at least electrically connecting the triggering head to the device to be triggered, and the control circuit comprises a logic triggering circuit having a plurality of interconnected logic gates with stable switching levels and two inputs controlled respectively by the state of the starting switch and the potential difference across said end poles of the input, said interconnected logic gates exhibiting a high input impedance to the input poles, said triggering head including a delay circuit connected between said starting switch and the corresponding input of said triggering logic circuit, a control light, and first and second control logic circuits, the control light being controlled by means of said first control logic circuit, said first control logic circuit having two inputs controlled respectively by the potential difference across said end poles of the input and the state of the second control logic circuit, said second logic circuit having two inputs respectively controlled by the state of the starting switch and the state of the delay circuit.

2. A triggering head as claimed in claim 1 including fastening means for fastening said case to the device to be triggered.

3. A triggering head as claimed in claim 1 wherein said starting switch comprises a mechanical switching device and an electronic switching device connected in parallel to the contacts of said mechanical switching device, and connected so as to keep said electronic switching device in the conductive state as a result of an actuation of the mechanical switching device.

4. A triggering head as claimed in claim 1 including a danger indication light connected between the terminals of the output.

5. A triggering head as claimed in claim 1 wherein said logic circuits are CMOS transistor circuits.

6. A triggering head as claimed in claim 1 wherein the case comprises a plurality of double-pole inputs connected in series with each other, the potential difference controlling the circuit being the potential difference across the end poles of said plurality of inputs.

7. A triggering head as claimed in claim 6 in combination with a wire loop connected to the end poles of the inputs of the triggering head, the triggering head functioning to trigger an associated device upon detection of a break in the wire loop wherein the wire loop is made of a bifilar wire connected to the two poles of a triggering head input, all triggering head inputs not connected to a loop being provided with shortcircuiting plugs.

8. A triggering head as claimed in claim 7 wherein the wire loop is made up of a wire whose ends are connected to the end poles of the said plurality of inputs.

9. A triggering head as claimed in claim 1 for firing lighting, incendiary or explosive devices, in combination with a connecting device wherein a plurality of devices are triggered from the same triggering head by means of said connecting device connected to the triggering head and to the various devices, said connecting device comprising a secondary electric power source and secondary delay control circuits connecting the secondary electric power source to the output terminals for connecting of the various devices.

10. A triggering head as claimed in claim 9 wherein the secondary control circuits have different time constants.

11. A triggering head as claimed in claim 10, wherein the various devices are physically separated and distributed to create an extended reaction zone.

12. A triggering head as claimed in claim 9 wherein the secondary control circuits are connected in series, the first of these circuits being controlled directly by the triggering head and the following circuits being each controlled by the preceding circuit.

* * * * *